US006425162B1

(12) United States Patent
Wang

(10) Patent No.: US 6,425,162 B1
(45) Date of Patent: Jul. 30, 2002

(54) RETRACTABLE HANDLE DEVICE HAVING ADJUSTABLE STRUCTURE

(76) Inventor: King Sheng Wang, No. 16, Lane 116, Da An Gang Road, Da Gia Town, Taichung Hsien (TW), 437

( * ) Notice: Subject to any disclaimer, the term of this patent is extended or adjusted under 35 U.S.C. 154(b) by 0 days.

(21) Appl. No.: 09/765,702

(22) Filed: Jan. 22, 2001

(51) Int. Cl.[7] ..... B25G 1/04; B62B 7/00

(52) U.S. Cl. ..... 16/113.1; 190/115; 280/655; 280/47.315

(58) Field of Search ..... 16/113.1, 405, 16/429; 190/115, 18 A; 403/109, 377; 280/655, 655.1, 37, 47.315

(56) References Cited

U.S. PATENT DOCUMENTS 5,689,854 A 11/1997 Wang ..... 16/113.1
5,704,725 A * 1/1998 Horing ..... 16/249
5,729,866 A * 3/1998 Chg ..... 16/405
5,862,898 A * 1/1999 Chang ..... 16/429
5,864,921 A * 2/1999 Chou ..... 16/405
6,141,828 A * 11/2000 Kuo ..... 16/113.1

* cited by examiner

*Primary Examiner*—Chuck Y. Mah
(74) *Attorney, Agent, or Firm*—Charles E. Baxley

(57) ABSTRACT

A retractable handle device includes one or more pairs of tubes slidably received in one or more pairs of conduits, and one or more sleeves engaged between the conduits and the tubes and each having a number of holes. One or more latches are secured to the tubes and each has a spring biased catch for selectively engaging with the holes of the sleeve and for micro-adjusting the tubes relative to the conduits and for allowing the tubes to be micro-adjusted relative to the conduits to different lengths. The latch may include two catches and two actuators received in a housing.

6 Claims, 10 Drawing Sheets

RETRACTABLE HANDLE DEVICE HAVING ADJUSTABLE STRUCTURE

BACKGROUND OF THE INVENTION

1. Field of the Invention

The present invention relates to a handle device, and more particularly to a retractable handle device for a suitcase or the like and having a micro-adjustable structure for adjusting to different lengths.

2. Description of the Prior Art

Typical retractable handle devices comprise two or more pairs of tubes slidably secured together for forming a retractable configuration, a handle disposed on top of the tubes, and a hand grip slidably engaged in the handle and coupled to a latch device for selectively securing the tubes together to adjust the retractable handle device to different lengths. U.S. Pat. No. 5,689,854 to Wang discloses one of the prior retractable handle devices for the suitcases. The handle or the tube may not be micro-adjusted relative to the other tubes.

The present invention has arisen to mitigate and/or obviate the afore-described disadvantages of the conventional retractable handle devices for suitcases.

SUMMARY OF THE INVENTION

The primary objective of the present invention is to provide a retractable handle device for a suitcase or the like including a configuration for allowing the retractable handle device to be micro-adjusted to different lengths.

In accordance with one aspect of the invention, there is provided a retractable handle device comprising two conduits, two tubes slidably received in the conduits respectively, at least one sleeve secured in a first of the conduits and engaged between the first conduit and a first of the tubes, the sleeve including a plurality of holes formed therein and arranged along a longitudinal direction thereof, and a latch secured to the first tube and moved in concert with the first tube, the latch including a spring biased catch for selectively engaging with the holes of the sleeve and for micro-adjusting the first tube relative to the first conduit. The tube may thus be micro-adjusted relative to the conduit to different lengths.

The first conduit includes an aperture formed therein, the sleeve includes at least one spring biased projection engaged in the aperture of the first conduit for securing the sleeve to the first conduit. The first conduit includes a slit formed therein for forming the spring biased projection in the sleeve.

The sleeve includes two members secured together with a bulge-and-notch engagement and includes a peripheral flange laterally extended outward therefrom for engaging with the first conduit. The first tube includes a groove formed therein, the sleeve includes a stop extended therefrom and slidably engaged in the groove of the first tube.

The latch includes a housing having at least one opening formed therein for slidably receiving the catch, and a spring engaged with the catch for biasing the catch to engage with the holes of the sleeve.

The catch includes a first inclined surface formed therein, the latch includes at least one actuator slidably received in the housing and having a second inclined surface formed therein for engaging with the first inclined surface of the catch and for disengaging the catch from the holes of the sleeve.

Further objectives and advantages of the present invention will become apparent from a careful reading of a detailed description provided hereinbelow, with appropriate reference to accompanying drawings.

BRIEF DESCRIPTION OF THE DRAWINGS

FIG. 1 is an exploded view of a retractable handle device in accordance with the present invention for a suitcase or the like;

DETAILED DESCRIPTION OF THE PREFERRED EMBODIMENT

Figure 1:
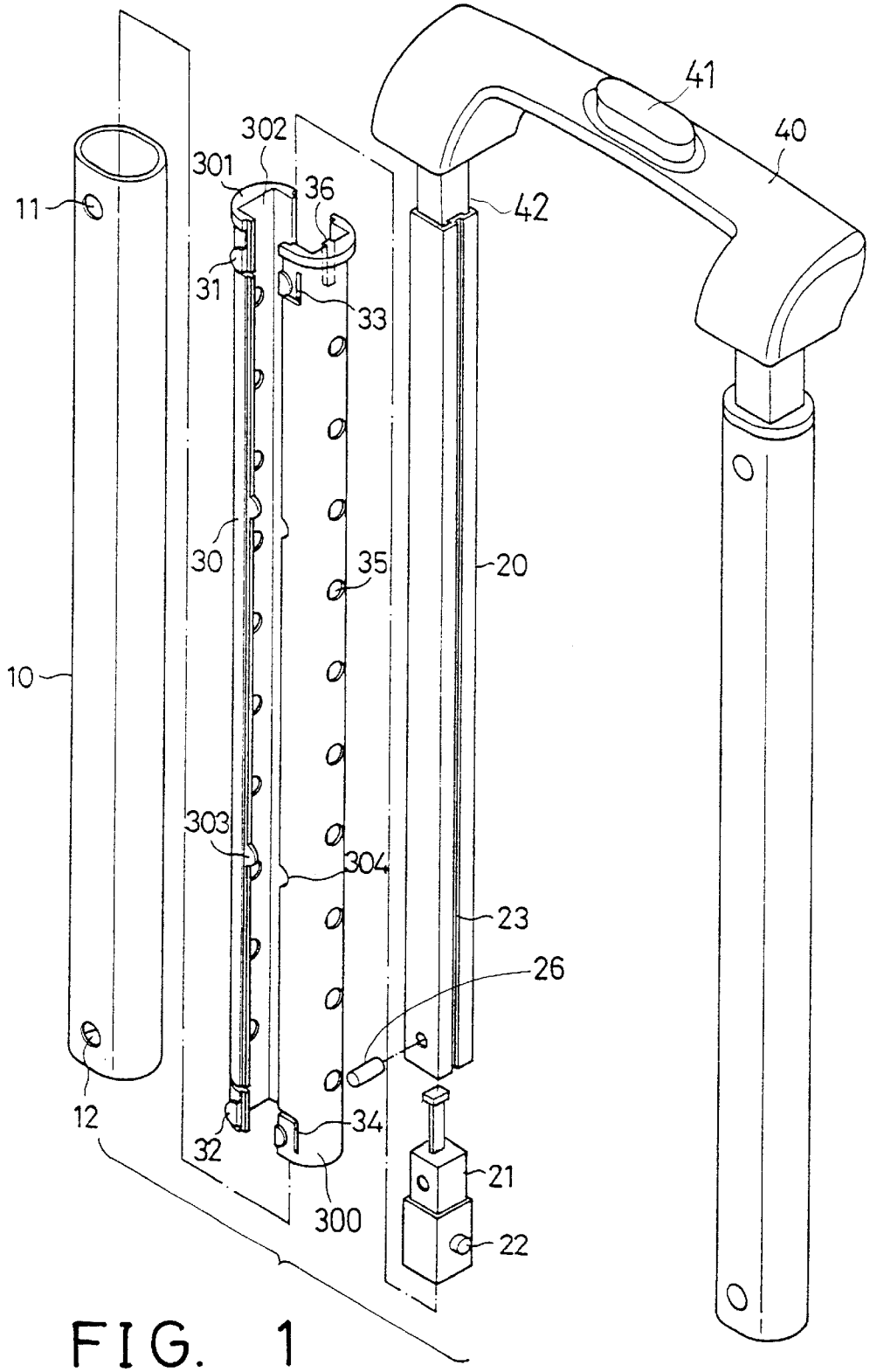
Figure 2:
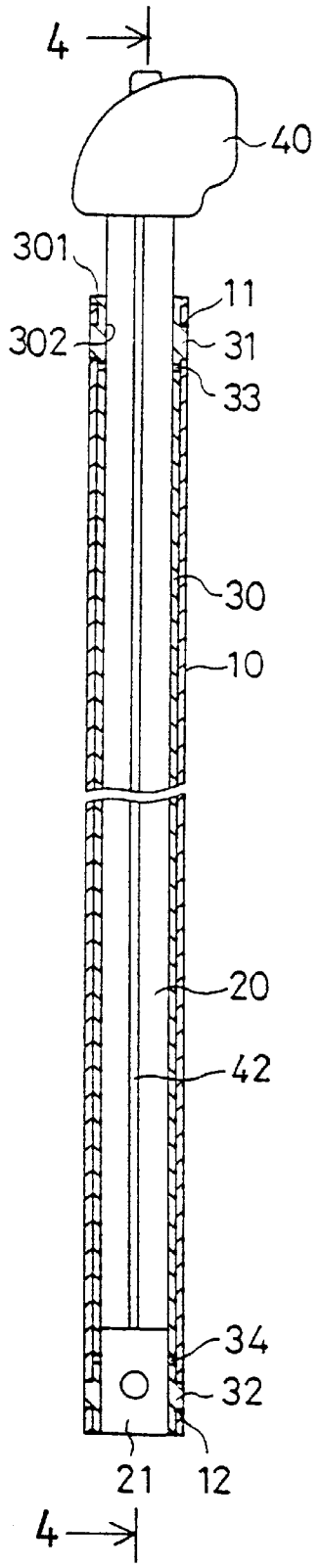
FIGS. 2, 3 are partial cross sectional views taken along lines 2—2 and 3—3 of FIG. 4 respectively.

Referring to the drawings, and initially to FIGS. 1–4, a retractable handle device in accordance with the present invention comprises a pair of conduits 10 for attaching or securing to the suitcase or the like, and a pair of tubes 20 slidably received in the conduits 10 for forming the retractable or the telescopic structure. One or more latches 21 are secured to the bottom of the tubes 20 with such as the fasteners 26 such that the latches 21 move in concert with the tubes respectively. A handle 40 is disposed on top of the tubes 20, a hand grip 41 is slidably received in the handle 40 and coupled to the latches 21, with such as the links 42 for actuating the latches 21 to selectively secure the tubes 20 to the conduits 10. The coupling of the handle 40 or the hand grip 41 to the latches 21 have been widely developed and are typical and will not be described in further details hereinafter.

Figure 3:
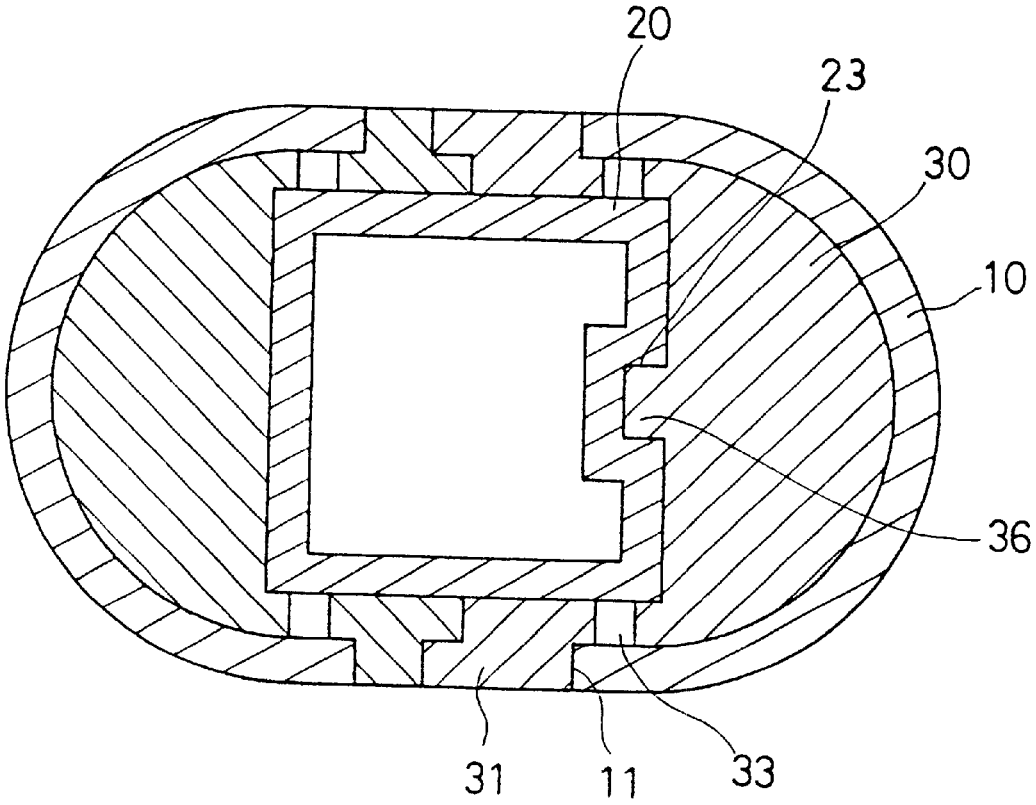
Figure 4:
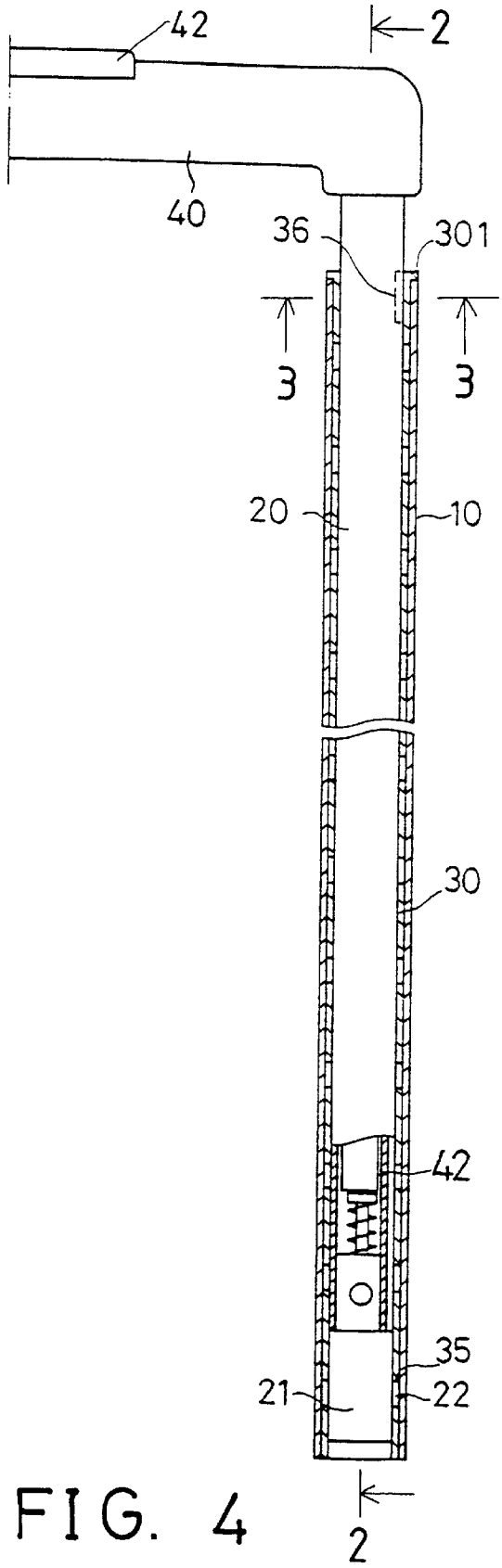
FIG. 4 is a cross sectional view taken along lines 4—4 of FIG. 2.

The tubes 20 each includes a groove 23 formed therein. The conduits 10 each includes an orifice 11 and an aperture 12 formed in the upper and the lower portions thereof respectively. Two sleeves 30 each includes two semi-cylindrical members 300 received and engaged between the conduits 10 and the tubes 20 respectively, and each includes a peripheral flange 301 extended laterally outward from one end thereof for engaging with the conduit 10. The sleeves 30 each includes a bore 302 having a non-circular cross section similar to that of the tube 20 for preventing the tube 20 from rotating relative to the sleeve 30. The members 300 of the sleeve 30 may be secured together with one or more pairs of bulge(303)-and-notch(304) engagements for preventing the members 300 from longitudinally moving relative to each other. The members 300 each includes a number of holes 35 formed therein and arranged along the longitudinal direction thereof, and each includes two spring-biased projections 31, 32 formed by the L-shaped slits 33, 34 respectively and formed in the ends thereof for engaging into the orifice 11 and the aperture 12 of the conduit 10 (FIG. 2) and for detachably securing the sleeve 30 in the conduit 10. One or both of the members 300 each includes a stop 36 extended therefrom and engaged in the groove 23 of the tube 20 (FIG. 3).

Figure 5:
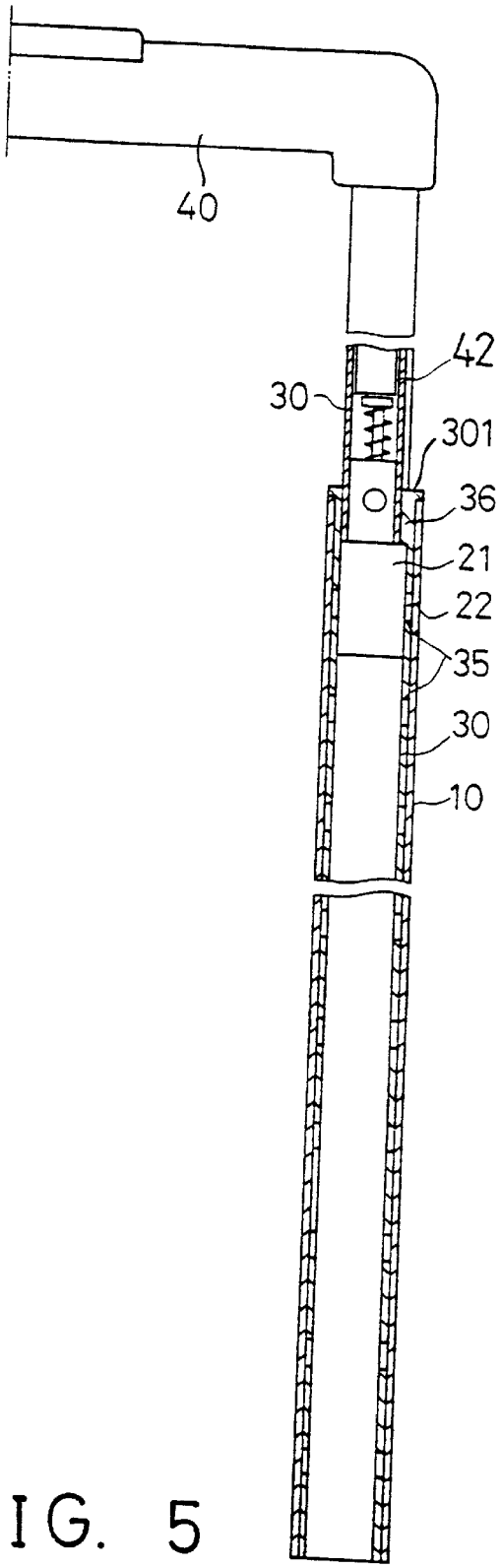
FIG. 5 is a partial cross sectional view similar to FIG. 4, illustrating the operation of the retractable handle device.
Figure 6:
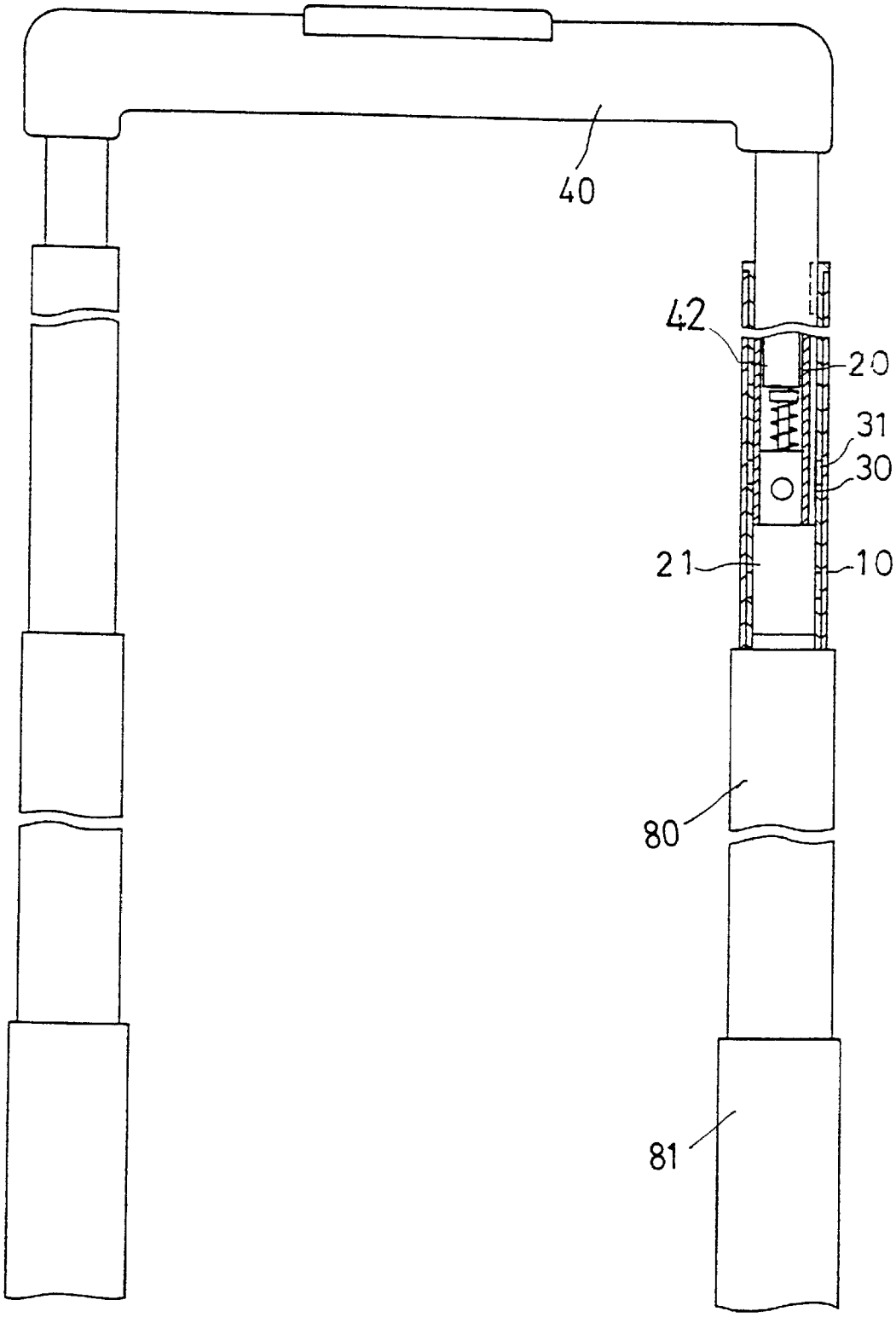
FIG. 6 is a partial cross sectional view similar to FIGS. 4 and 5, illustrating the other application of the retractable handle device.

As shown in FIG. 6, one or more pipes 80, 81 may further be provided for slidably receiving the conduits 10 and the tubes 20 for forming a multi-section retractable or telescopic structure. The latches 21 each includes one or more catches 22 for engaging through the holes 35 of the sleeve 30 (FIGS. 4, 5) for adjustably securing the tube 20 to the sleeve 30 and thus to the conduit 10 and for micro-adjusting the tube 20 relative to the sleeve 30 and the conduit 10, such that the retractable handle device may be micro-adjusted to different lengths. The latch 21 or the catch 22 may engage with the stop 36 (FIG. 5) for limiting the relative sliding movement between the tube 20 and the sleeve 30 and for preventing the tube 20 from being disengaged from the sleeve 30 and the conduit 10.

Figure 7:
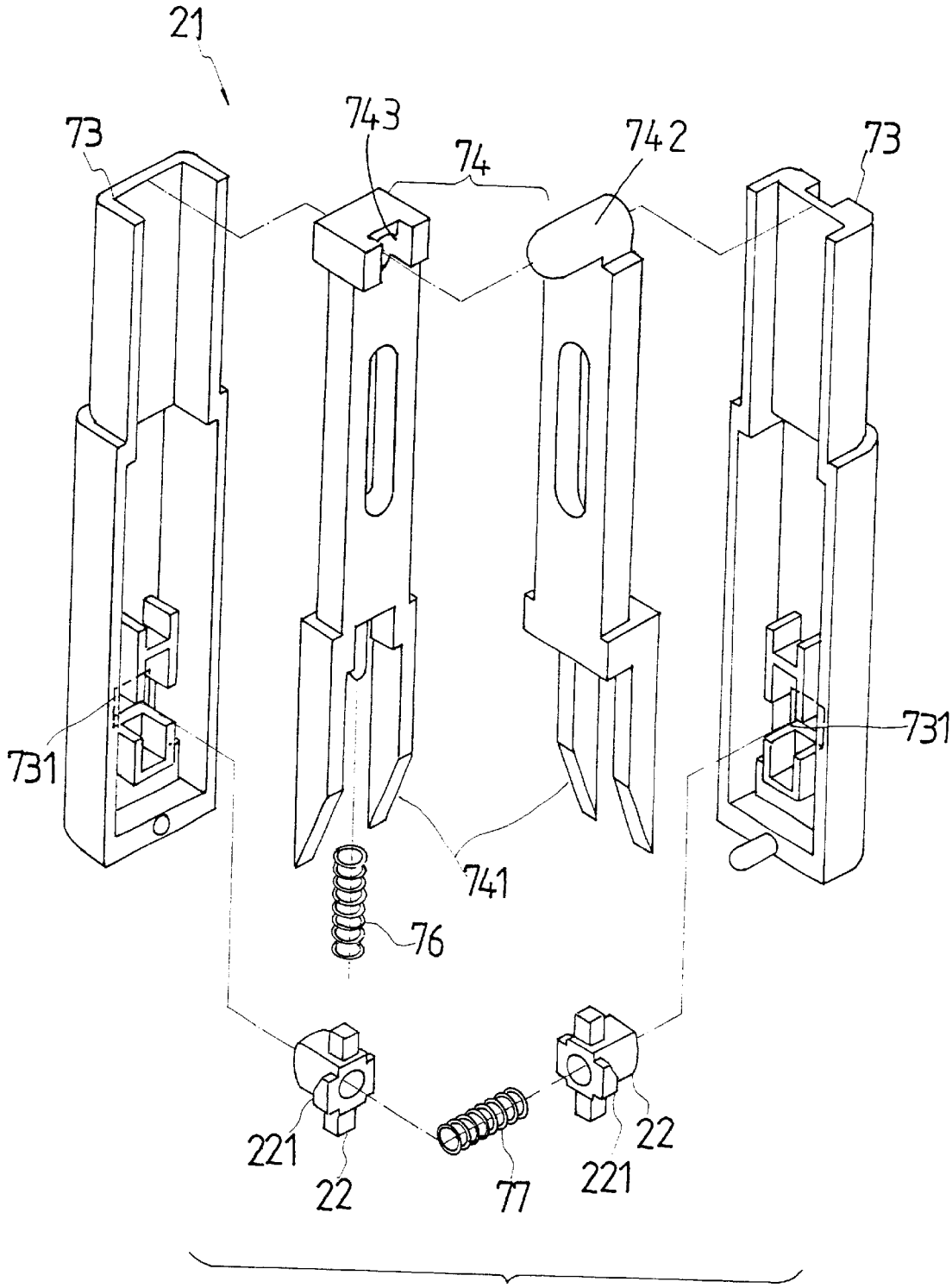
FIG. 7 is an exploded view showing the actuator of the retractable handle device.
Figure 9:
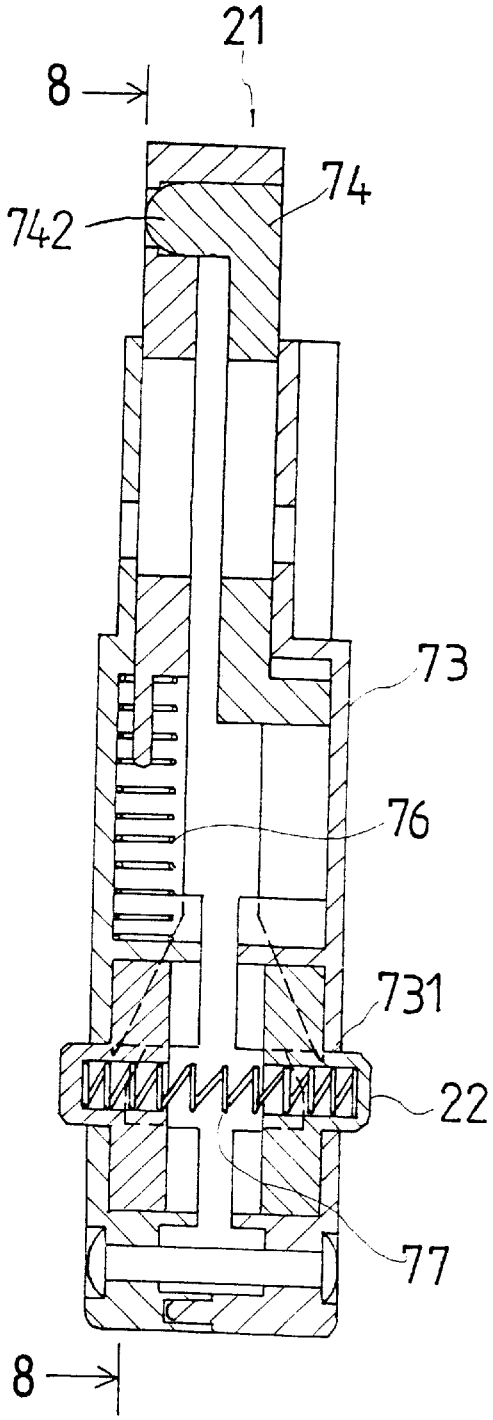
FIG. 9 is a partial cross sectional view taken along lines 9—9 of FIG. 8.
Figure 8:
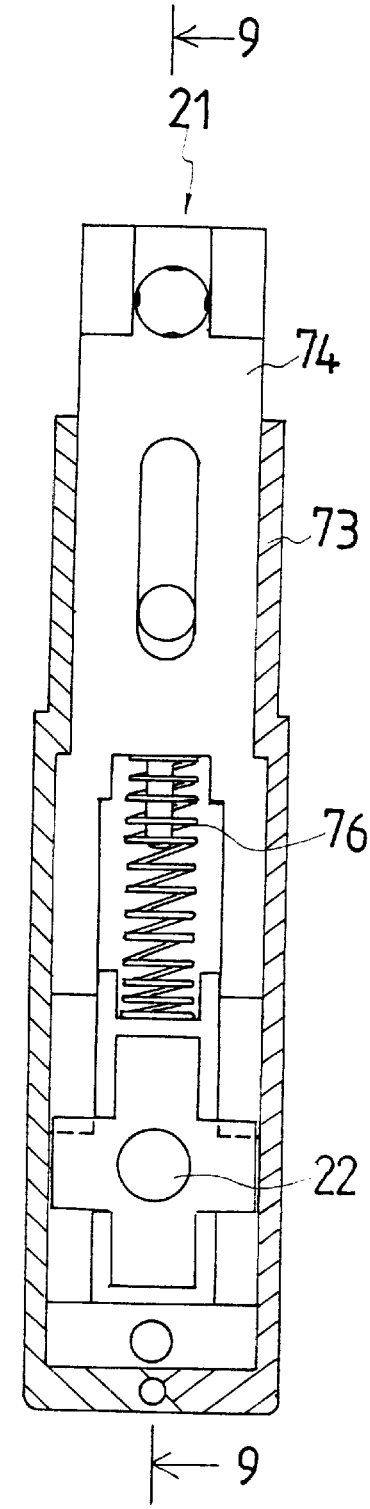
FIG. 8 is a partial cross sectional view taken along lines 8—8 of FIG. 9.

Referring next to FIGS. 7–9, illustrated is an example of the latch 21 which includes a housing 73 having two members secured together, and which includes one or two actuators 74 secured together by such as a bulge(742)-and-notch(743) engagement. The actuators 74 are coupled to the hand grip 41 or the handle 40 with the conventional method or configuration, and each includes one or more inclined surfaces 741 formed therein, such as formed in the bottom thereof. The housing 73 includes one or two openings 731 formed therein for receiving one or more catches 22 therein, for example, two catches 22 are illustrated and are slidably received in the housing 73 and each includes an inclined surface 221 formed therein. A spring 77 is engaged between the catches 22 for biasing the catches 22 away from each other. A spring 76 is engaged with either or both of the actuators 74 for biasing and disengaging the inclined surfaces 741 of the actuators 74 from the catches 22. The inclined surfaces 741 of the actuators 74 may be forced to engage with the inclined surfaces 221 of the catches 22 for moving and disengaging the catches 22 from the holes 35 of the sleeve 30 and for allowing the tube 20 to be moved or adjusted relative to the sleeve 30 when the actuators 74 are actuated by the handle 40 or by the hand grip 41.

Figure 11:
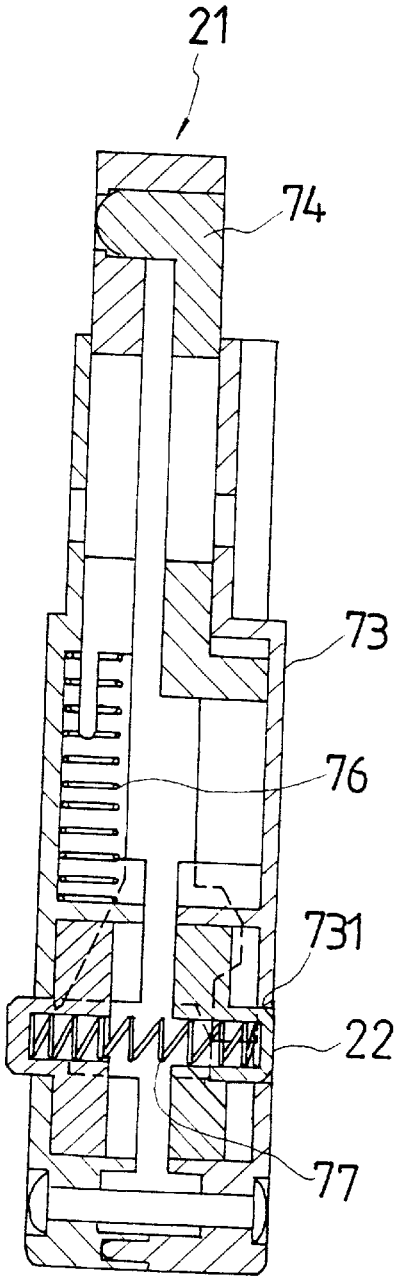
FIGS. 10, 11 are partial cross sectional views similar to FIG. 9, illustrating the other operation of the retractable handle device.
Figure 10:
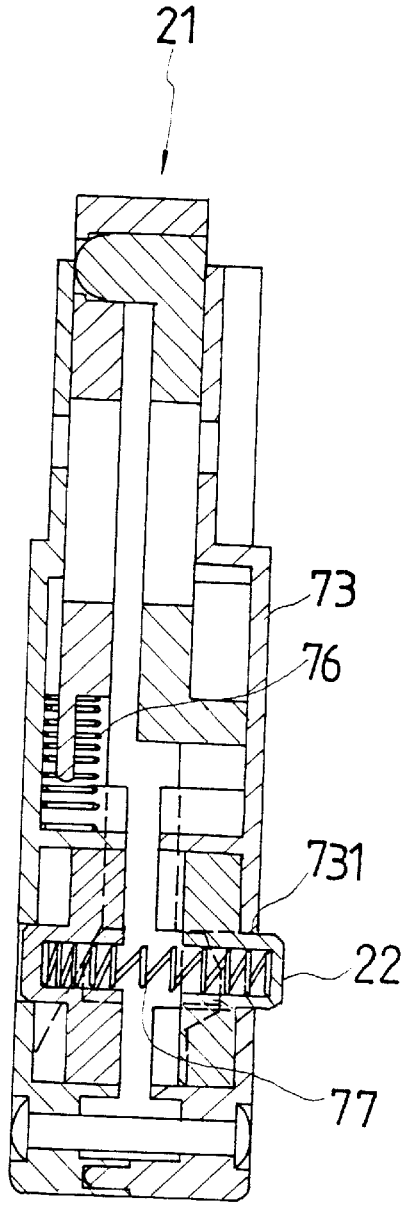
Figure 12:
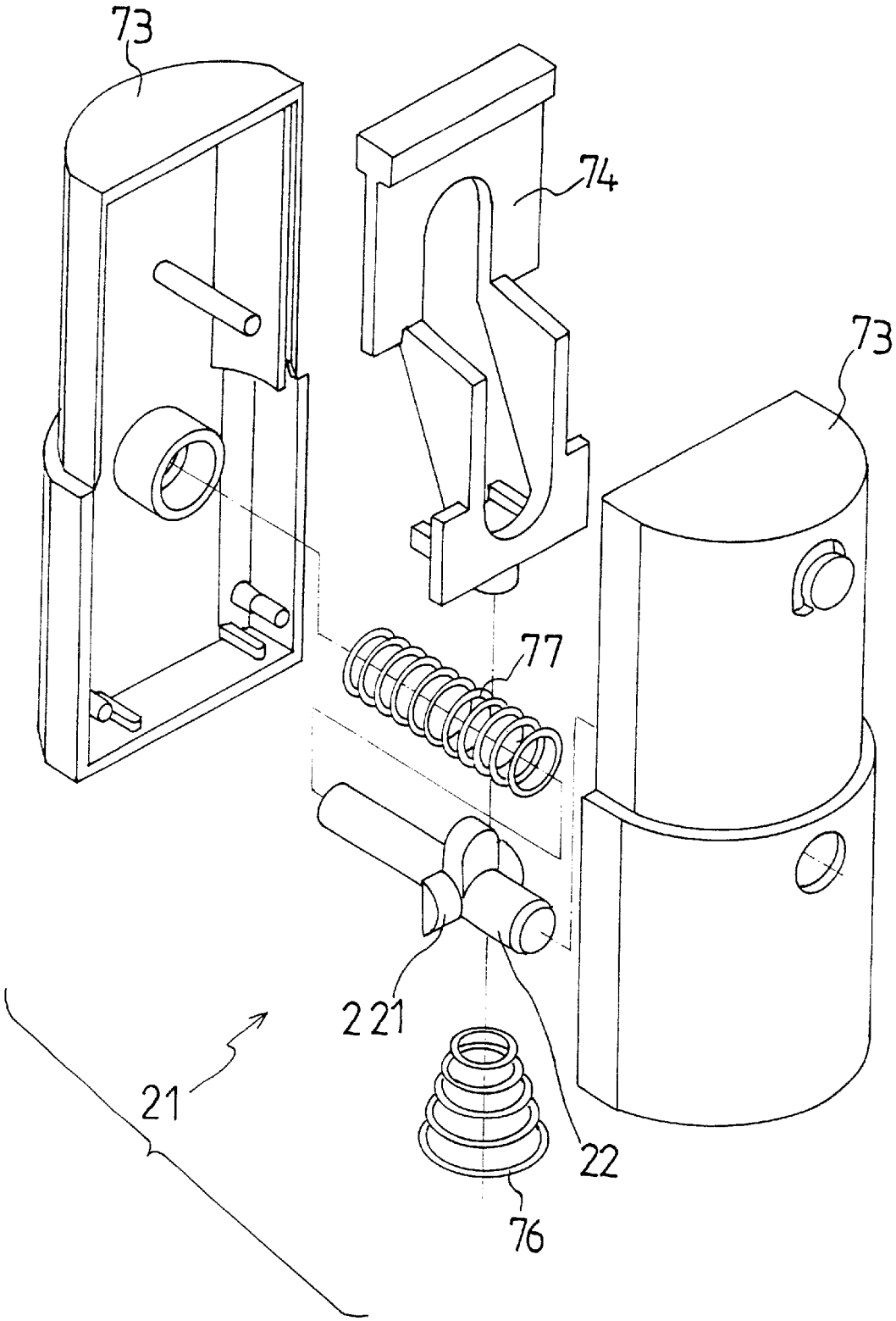
FIG. 12 is an exploded view illustrating the other application of the actuator of the retractable handle device.

As shown in FIGS. 10, and 11, only one of the actuators 74 includes one or more inclined surfaces 741 formed therein, or only one of the catches 22 includes an inclined surface 221 formed therein, such that only one of the catches 22 may be actuated or retracted or moved inward of the tube or disengaged from the holes 35 of the sleeve 30. As shown in FIG. 12, the latch 21 may include a single actuator 74 for engaging with a single catch 22 that is biased by a spring 77.

In operation, as shown in FIGS. 1, 4, 5, and 7–9, the catches 22 may be biased to selectively engage with the holes 35 of the sleeve 30 in order to micro-adjust the tube 20 relative to the sleeve 30 and the conduit 10. The provision and the engagement of the sleeve 30 between the conduit 10 and the tube 20 allows the tube 20 to be easily and quickly and solidly adjusted relative to the sleeve 30 and thus to the conduit 10.

Accordingly, the retractable handle device in accordance with the present invention includes a configuration for allowing the retractable handle device to be micro-adjusted to different lengths.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A retractable handle device comprising:

a) a first conduit and a second conduit, said first conduit includes an aperture formed therein, b) a first tube and a second tube slidably received in said first and said second conduits respectively, c) at least one sleeve secured in said first conduit, said first tube being slidably received in said first conduit and slidable relative to said at least one sleeve, said at least one sleeve including a plurality of holes formed therein and arranged along a longitudinal direction thereof, said at least one sleeve including at least one spring biased projection engaged in said aperture of said first conduit for securing said at least one sleeve to said first conduit, and d) a latch secured to said first tube and moved in concert with said first tube, said latch including a spring biased catch for selectively engaging with said holes of said at least one sleeve and for micro-adjusting said first tube relative to said first conduit.

2. The retractable handle device according to claim 1, wherein said sleeve includes two members secured together with a bulge-and-notch engagement.

3. The retractable handle device according to claim 1, wherein said sleeve includes a peripheral flange laterally extended outward therefrom for engaging with said conduit.

4. The retractable handle device according to claim 1, wherein said latch includes a housing having at least one opening formed therein for slidably receiving said catch, and a spring engaged with said catch for biasing said catch to engage with said holes of said sleeve.

5. The retractable handle device according to claim 4, wherein said catch includes a first inclined surface formed therein, said latch includes at least one actuator slidably received in said housing and having a second inclined surface formed therein for engaging with said first inclined surface of said catch and for disengaging said catch from said holes of said sleeve.

6. A retractable handle device comprising:

a) two conduits, b) two tubes slidably received in said conduits respectively, c) at least one sleeve secured in a first of said conduits, a first of said tubes being slidably received in said first conduit and slidable relative to said at least one sleeve, said at least one sleeve including a plurality of holes formed therein and arranged along a longitudinal direction thereof, and d) a latch secured to said first tube and moved in concert with said first tube, said latch including a spring biased catch for selectively engaging with said holes of said at least one sleeve and for micro-adjusting said first tube relative to said first conduit, said first tube including a groove formed therein. said at least one sleeve including a stop extended therefrom and slidably engaged in said groove of said first tube.

* * * * *